US005209309A

United States Patent [19]

Wilson

[11] Patent Number: 5,209,309

[45] Date of Patent: May 11, 1993

[54] TRIANGULAR CORE CUTTING TOOL

[76] Inventor: Bobby T. Wilson, 3300 Maxwell, Midland, Tex. 79707

[21] Appl. No.: 746,777

[22] Filed: Aug. 16, 1991

[51] Int. Cl.[5] ..... E21B 49/06

[52] U.S. Cl. ..... 175/58; 175/77; 175/78

[58] Field of Search ..... 175/58, 59, 60, 20, 175/77, 78

[56] References Cited

U.S. PATENT DOCUMENTS

| | | | |
|---|---|---|---|
| 1,674,117 | 6/1928 | Mason, Jr. | 175/58 X |
| 1,705,623 | 3/1929 | Mason, Jr. | 175/58 X |
| 3,173,500 | 3/1965 | Stuart et al. | 175/78 X |
| 3,353,612 | 11/1967 | Bannister | 175/78 X |
| 3,405,772 | 10/1968 | Wisenbaker et al. | 175/77 |
| 3,430,716 | 3/1969 | Urbanosky | 175/311 X |

FOREIGN PATENT DOCUMENTS

| | | | |
|---|---|---|---|
| 571591 | 9/1977 | U.S.S.R. | 175/58 |
| 605888 | 5/1978 | U.S.S.R. | 175/58 |

*Primary Examiner*—Hoang C. Dang

*Attorney, Agent, or Firm*—Ross, Howison, Clapp & Korn

[57] ABSTRACT

A sidewall coring device includes a housing (12) which is operable to be disposed on the end of a drill string. A core tube (18) is disposed on one side of the housing on the interior thereof with an opening (20) provided for receiving core material. A coring mechanism (24) is provided that tilts outward from the housing with blades (26) engaging the sidewall. A passageway (14) allows mud to flow from the drill string downward therethrough to provide a hydraulic force to a hydraulic mechanism (32) to drive saw blades (26). The stabilizing mechanism (32) is provided for forcing the housing (12) against the sidewall of the bore to bore hole (10). The drill string imparts a downward force onto the coring blades (26) to form core segments (40) which are diverted into the core tube (18) by a diverter mechanism (22).

17 Claims, 8 Drawing Sheets

TRIANGULAR CORE CUTTING TOOL

TECHNICAL FIELD OF THE INVENTION

This invention pertains in general to core sampling devices, and more particularly, to a sidewall coring device.

BACKGROUND OF THE INVENTION

In searching for oil, gas and other underground deposits of minerals, exploratory holes are drilled and core samples are taken so that an evaluation may be made of the geological, mineralogical and physical properties and characteristics of the strata of interest. Information is obtained from these samples as to, for example, porosity, permeability, fluid content, grain size, compressibility, acoustical qualities, mineral composition and acid solubility.

In order to obtain an accurate evaluation of the properties and characteristics of the strata of interest, the sample is preferably taken over a substantial length of the bore hole. There are two types of coring procedures, the first is drilling and retrieving the bore in a central core, the core being substantially the size of the hole itself, and second, retrieving a sample from the sidewall of the bore hole. In the central coring method, the core is formed simultaneous with the drilling of the bore hole which restricts the core sample to the bottom of the bore hole. Therefore, the string must be lifted up at predetermined times during the drilling operation and the coring mechanism lowered into the hole.

In sidewall coring operation, a wireline system is typically utilized to lower the coring device down into the hole and then retrieve the samples. In one type of coring device, U.S. Pat. No. 3,405,772, issued to J. D. Wisenbaker et al. on Oct. 15, 1968, discloses a method for retrieving a triangular core sample. This device is lowered into the hole by wireline and then held against the walls of the bore hole at a predetermined distance therein. Two saw blades are then pushed outward against the sidewall to cut a triangular shaped core as the tool is pulled upward. A rotating canister is provided with a plurality of tubes, each containing a ten foot section of core. An electric motor is provided which is powered through the wireline to drive the saw blades.

A similar type of system is also illustrated in U.S. Pat. No. 3,173,500, issued to R. W. Stewart et al. on Mar. 16, 1965, and U.S. Pat. No. 3,430,716, issued to H. J. Urbanosky on Mar. 4, 1969.

In view of the above disadvantages with conventional coring and sidewall coring, there exists a need for a sidewall coring system that provides the ability to extract a continuous small strip of the sidewall or multiple intervals thereof without requiring the use of a wireline system or external power.

SUMMARY OF THE INVENTION

The present invention disclosed and claimed herein comprises a side wall coring tool for removing a selected section of the formation within a bore hole. The coring tool includes a housing for being lowered into the bore hole on the end of a drill string, the drill string operable to impart a vertically directed force thereto along the longitudinal axis of the bore hole. A longitudinal core tube is formed interior to the housing and having an opening in one end for receiving core materials. A coring device is contained in the housing and operable to be disposed in a retracted non-cutting position in the housing and in an extended cutting position for core cutting. The coring device is powered in the extended cutting position by a power source. When in the extended position, the coring device is operable to be forced into the sidewall of the bore hole. A motivating device is provided for placing the coring device in the extended cutting position. When the coring device is in the extending cutting position, a core is formed from the sidewall of the bore hole in response to vertical movement of the housing. A diverting device is provided for diverting the core after formation thereof into the open end of the core tube. The vertical movement of the housing forces the core into the core tube.

In another aspect of the present invention, the coring tool is operable to be rotationally oriented from the surface. The core tube internal to the coring device is oriented such that it is on the side of the housing from which the coring device extends. The core form is in an essentially triangular shaped cross section.

In yet another aspect of the present invention, the coring device includes two rotating blades that rotate in a plane parallel to the longitudinal axis of the bore such that the planes of the blades intersect within the formation when the coring device is in the extended cutting position. The outermost edges of the coring blades are proximate to each other when in the extended cutting position. The blades are reciprocated from the retracted position to the extended cutting position by an outward and downward movement into the formation. A stabilizing device is provided on the opposite side of the housing from the coring device when in the extended cutting position to force the housing against the formation at the point where the core is formed.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
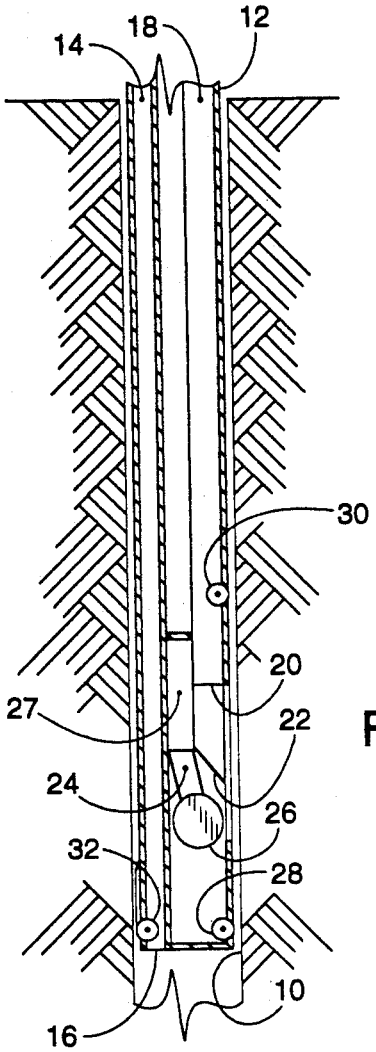
FIG. 1 illustrates a cross-section of the coring tool being lowered into a previously drilled bore hole.

Referring now to FIG. 1, there is illustrated a cross-sectional diagram of a bore hole 10 which has lowered therein the coring tool of the present invention. The coring tool is comprised of an outer housing 12 which is operable to be attached to the lower end of a drill string at a point not shown. The coring tool is lowered into the bore hole 10 after the bore hole 10 has been formed. Unlike conventional coring which requires further drilling of the bore hole by the coring tool, the core tool of the present invention can be lowered to any location in the bore hole and the coring procedure initiated. This allows samples of the formation to be taken at various intervals along the depth of the bore hole 10 after drilling thereof. This is contrary to conventional coring techniques which require the entire drill string to be extracted from the well for each coring operation, which can be tedious, time consuming and expensive.

The coring tool has a mud passageway 14 formed along one side thereof down through the interior of the housing 12 and in communication with the center of the drill string. The mud can be forced downward from the surface through the drill string and through the passageway 14 out through an outlet 16. A core tube 18 is also provided in the interior of the housing 12 and disposed adjacent the opposite side of the coring tool from the mud passageway 14. When a core is extracted from the sidewall of the bore hole 10, it is funneled upward and into the core tube 18 for containment therein.

The core tube 18 extends downward along the side of the housing 12 on the interior thereof and has a lower opening 20 formed therein. A core guide 22 which acts as a diverting mechanism is provided on the lower end of the core tube 18 and the lower opening 20 and is illustrated in the retracted position 22. The core guide 22 will be described in more detail hereinbelow. A core cutting mechanism 24 is provided at the lower end of the core tool in the housing 12 and proximate to the lower opening 20 of the core tube 18.

The core cutting mechanism 24 and coring blades 26 are powered by a hydraulic mechanism 27 which is powered by mud flowing through the passageway 14, as will be described hereinbelow. Although illustrated above the core cutting mechanism 24, the hydraulic mechanism 27 in the preferred embodiment is located at the lowermost portion of the housing 12. The core cutting mechanism 24 is illustrated in the retracted position and has contained thereon coring blades 26. Additionally, the core cutting mechanism 24 is illustrated as rotating from a pivoting mechanism that allows rotation outward therefrom. This configuration is for illustrative purposes only, the detail of the cutting mechanism 24 described hereinbelow.

A lower stabilizing wheel 28 is provided on the lower end of the housing 12 and beneath the core cutting mechanism 24. A stabilizing wheel 30 is also provided on the same side of the housing 12 as the core cutting mechanism 24 and above the core cutting mechanism 24. Stabilizing wheels 28 and 30 are shown in a retracted position. On the diametrically opposite side to the wheels 28 and 30 is provided a stabilizing wheel 32, also shown in the retracted position. The stabilizing wheel 32 is disposed on the lower end of the core tool. With the stabilizing wheels 28–32, the core guide 22 and the coring cutting mechanism 24 in the retracted position, the coring tool is operable to be lowered into the bore hole 10 or retracted therefrom by the drill string itself. In addition, it can be seen that the side of the coring tool on which the core tube 18 and the core cutting mechanism 24 are disposed can be oriented at any position within the bore hole since there is a solid and fixed connection between the coring tool and the drill string. This is distinguished over wireline type coring mechanisms for use with sidewall coring that have no means for providing any type of orientation.

Figure 2:
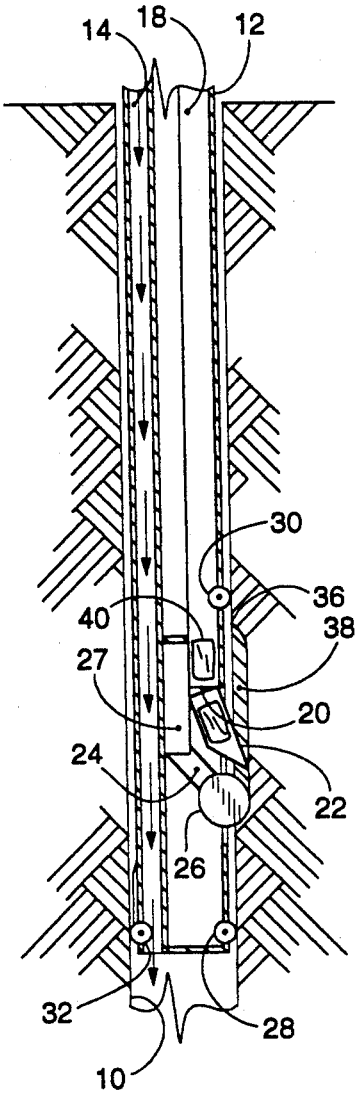
FIG. 2 illustrates the coring operation wherein the coring tool is being lowered into the bore hole while extracting a portion of the sidewall.

Referring now to FIG. 2, there is illustrated a cross-sectional diagram of the core tool in the bore hole and in the coring position. After the coring tool has been lowered to a position corresponding to a desired formation to be cored, mud is pumped through the drill string and the passageway 14. When mud flow is initiated through the passageway 14, power is provided to the hydraulic mechanism 27. The hydraulic mechanism 27 is then operable to force the core cutting mechanism 24 and coring blades 26 outward from the inside of the coring tool directly beneath the opening 20 in the coring tube 18. Simultaneously therewith, the stabilizing wheels 28 and 30 extend slightly outward from the outer surfaces of the housing 12 on the same side as the coring tube 18 to maintain the wall in relatively close proximity to the sidewalls of bore hole 10. The stabilizing wheel 32, on the other hand, is operable to force the diametrically opposite side of the housing 12, which contains the core tube 18 and the coring mechanism 20, against the sidewall of the bore hole 10.

When the mud flow is initiated through passageway 14, the coring blades 26 begin to rotate and are forced into the sidewall of the bore hole 10 at a point 36. At the same time, the core guide 22 rotates outward against the sidewall of the bore hole 10 just above the coring blades 26. The drill string is then lowered at a predetermined rate into the bore hole 10 to allow the coring blades 26 to make a triangular-shaped passageway 38 down the sidewall of the bore hole 10. During this time, mud flow is continued through passageway 14 and the drill string is not rotated. This results in a triangular shaped core being formed which is segmented as it moves up the core guide 22 into the core tube 18, resulting in segments 40 being forced upward into the core tube 18. The length of the passageway 38 that is cut into the sidewall of the bore hole 10 is a function of the length of the core tube 18 and the inherent mechanical limitations that exist for forcing core segments 40 upward into the core tube 18. The force that moves the core segments 40 up into the tube is a function of the downward travel of the drill string and the type of formation being cored.

When the coring operation is complete, mud flow is terminated through the passageway 14 and the coring blades 26 retract back into the housing 12 along with the core guide. The core tool can then be removed from the bore hole 10 with the core segments 40 disposed in the core tube 18.

Figure 3:
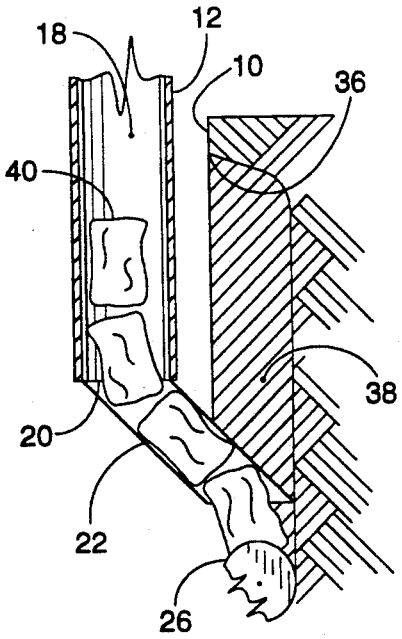
FIG. 3 illustrates a detail of the coring blade and the receiving end of the coring tube.

Referring now to FIG. 3, there is illustrated a detail of the core segments 40 that traverse up the core tube 18 through the core guide 22. As the triangular-shaped core is being cut by the core guide 26, the removed section of the core is forced upward into the core guide 22 by the downward motion of the drill string and coring tool. The diverter tube 22 is operable to force the removed portion of the core away from the sidewall and towards the opening 20. This lateral displacement from the sidewall of the bore hole 10 to the opening 20 results in fracturing of the core into the core segments 40. Continued operation of the coring blades 26 forces the segments 40 up through opening 20 into the core tube 18. Typically, the core tube 18 will be manufactured from a material such as PVC or some type of material having a relatively strong, smooth surface. This will allow the core segments 40 to slide therealong with minimal possibility for jamming.

Figure 4:
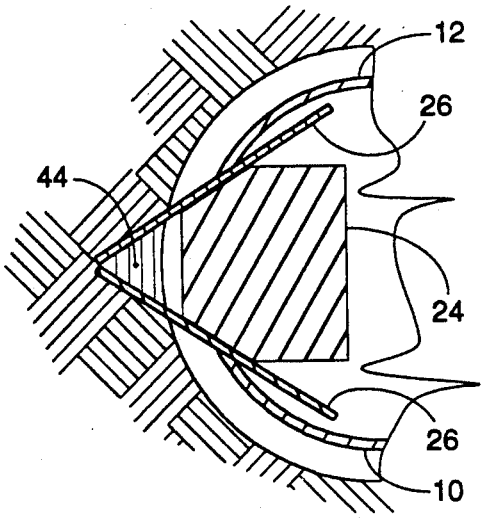
FIG. 4 illustrates a cross-sectional view of the coring blade.

Referring now to FIG. 4, there is illustrated a top sectional view of the coring blades 26 inserted into the sidewall of the bore hole 10. The coring blades 26 are operable to cut a core 44 out of the sidewall of the bore hole 10. The core 44 is still attached at the lower end thereof, and, as described above, is segmented into core segments 40 when it enters the core guide 22. As can be seen in FIG. 4, there are two coring blades 26, each attached to the coring mechanism 24 and disposed at an angle relative to the central axis of bore hole 10 such that they come together at their outer peripheral edges within the formation to provide the triangular-shaped core 44. The coring blades 26 are rotated in a direction such that the peripheral edges thereof enter the uppermost portion of the core rotating into the formation and out the lower end of the formation. This provides additional pulling force in a lateral direction from the central axis of the bore hole 10 to further assist movement of the core cutting mechanism 24 outward into the formation.

Figure 5:
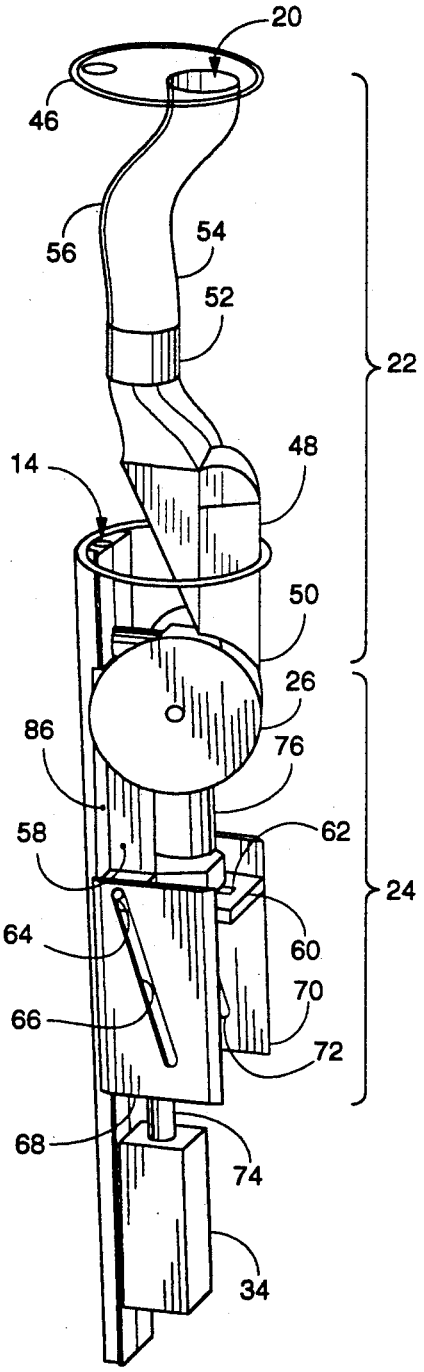
FIG. 5 illustrates a detail of the core guide and the core cutter.

Referring now to FIG. 5, there is illustrated a detail of the core guide 22 and the core cutting mechanism 24. The core tube 18 is typically disposed in a flow and core tube assembly (not shown) that is disposed above the opening 20. The interface between the core guide 22 and the core tube 18 is illustrated by an interconnecting hub 46. This defines the plane in which the opening 20 is disposed. The opening 20, as described above, interfaces with the inlet to the core tube 18. The core guide 22 is comprised of a guide shoe 48 that has a leading end 50 and an upper connecting end 52. The guide shoe 48 is movable with respect to the core cutting mechanism 24 such that it moves outward from the housing 12 during the coring operation with the end 50 disposed in close proximity to the coring blades 26. The upper connecting portion 52 is connected to a flexible guide 54 which is connected between the connecting portion 52 and the opening 20. The opening 20 is biased toward the coring side of the housing such that the flexible portion 54 has a bend therein, as indicated by a reference numeral 56, when the guide shoe 48 is retracted into the housing 12. When the guide shoe 48 is extended from the housing with the core cutting mechanism 24, the flexible portion 54 is essentially straight to allow the segments 40 to pass there through.

The core cutting mechanism 24 is comprised of a reciprocating drive housing 58 that is slidingly mounted on a plate 60 and operable to reciprocate outward along a slot 62 in the plate 60. The drive housing has pins 64 disposed on either side thereof that cooperate with associated slots 66 and 72. The slot 66 is disposed in a fixed plate 68 on one side of the housing 58 and the slot 72 is disposed in a fixed plate 70 on the other side thereof. The pin 64 is disposed at the upper end of the fixed plate 68 and toward the rear of the fixed plate 68 to provide the retracted position for the core mechanism 24.

The plate 60 is mounted on the end of a piston 74 that is controlled by a hydraulic cylinder 34 on the lower end thereof. When the plate 60 is pulled downward, the pin 64 slides downward in the slot 66, the slot 66 oriented such that the lower end thereof is disposed toward the front portion of the plate 68. In a like manner, the slot 72 allows the pin on the other side of the housing 58 (not shown) to slide downward and outward. In this manner, the housing 58 is urged downward and outward along the slot 62 in the plate 60. Therefore, the coring blades 26 are operable to be pushed outward and downward relative to the housing in addition to the core guide shoe 48. The housing 58 contains a hydraulic motor 76 that drives the coring blades 26.

Figure 6:
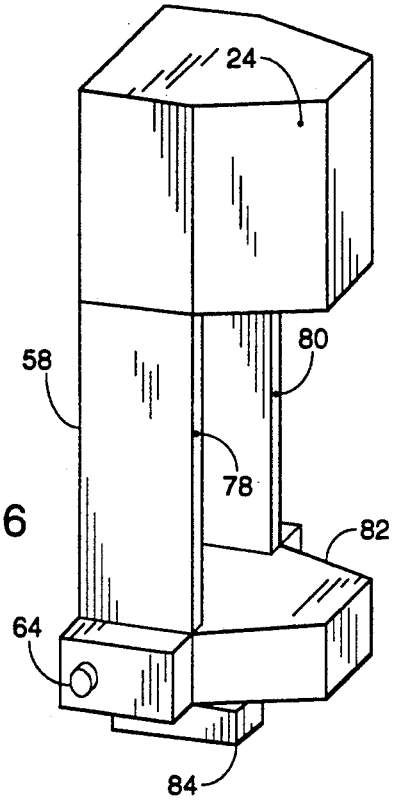
FIG. 6 illustrates a detail of the gearbox housing.

Referring now to FIG. 6, there is illustrated a detail of the housing 58. The housing 58 contains the gearbox 24 which is disposed on the upper end of two vertical plates 78 and 80. The two vertical plates 78 and 80 rise upward from a base plate 82. The hydraulic motor 76 (not shown) is disposed on the base plate 82 and supported between the vertical plates 78 and 80 to cooperate with the gearbox 24. The pins 64 are disposed on the lateral sides of the base plate 82. A guide 84 is provided on the bottom side of the base plate 82, the guide 84 operable to cooperate with the slide 62 to allow the housing 58 to reciprocate outward from the housing.

Figure 7:
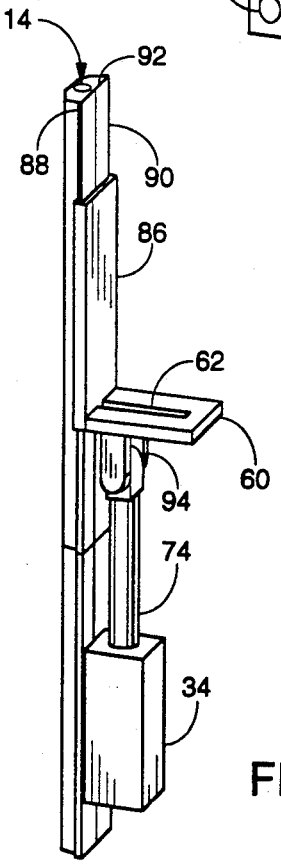
FIG. 7 illustrates a detail of the sliding mechanism for extending the core cutter.

Referring now to FIG. 7, there is illustrated a detail of the sliding mechanism and plate 62. The plate 62 is disposed on a sliding plate 86 and extending outward therefrom at a right angle. The sliding plate 86 is disposed parallel to the longitudinal axis of the housing 12 and slides along guide rails 88 and 90 on a rack 92. The rack 92 has the mud passageway 14 disposed through the center thereof and is disposed on the rear portion of the housing 12. The hydraulic cylinder 34 and the piston 74 are anchored on the lower end of the rack 92. The piston 74 is attached at the upper end thereof to a bracket 94 on the lower side of the plate 62. In operation, the piston 74 pulls the bracket 94 downward toward the hydraulic cylinder 34 resulting in reciprocation of the plate 86 downward and reciprocation outward of the housing 58 in the slot 62.

Figure 8:
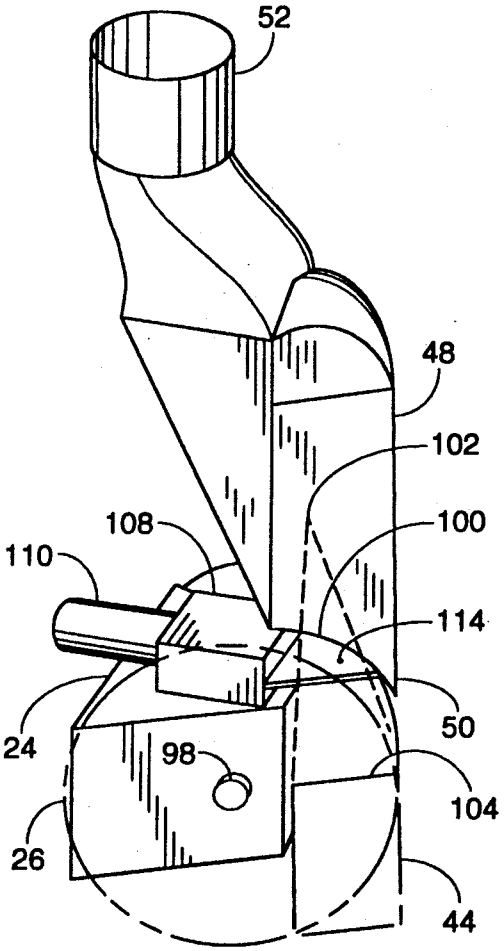
FIG. 8 illustrates a detail of the core cutter in the extended position.

Referring now to FIG. 8, there is illustrated a detail of the coring mechanism 24 in the extended position wherein the core sample is initially cut. The outermost one of the coring blades 26 is illustrated in phantom. The coring blades 26 are driven by gearbox 24 through axles 98. When the core mechanism 24 is initially reciprocated outward, it engages the side wall of bore hole 10. The guide shoe 48 is pulled outward with the core cutting mechanism 24 such that the lowermost end 50 trails the core blades 26. The lower edge of each side of the guide shoe 48 is formed by an arcuate edge 100, which arcuate edge 100 follows the arc of the coring blades 26, one of the arcuate edges 100 not shown. A minimum distance is provided between the arcuate edge 100 and the rotating outer surface on the peripheral edge of the coring blades 26.

When the core 44 is initially formed, the core 44 begins at an apex 102 (shown in phantom line) with a triangular cross section. The cross sectional size increases until the core mechanism 24 is fully extended, at which time the entire drill string is lowered into the bore hole 10 to provide the downward movement of the core tool. This is initiated at a position 104 on the core 44.

When the coring operating is complete, it is necessary to sever the core and retract the core guide 22 and the core cutting mechanism 24 back into the housing 12. However, it is necessary to first sever the core 44 and then pull upward to disengage the coring blades 26 from the sidewall at the bore hole 10. A core catcher 108 is provided which operates in a "guillotine" fashion with a piston 110 operable to active the core catcher 108. The core catcher 108 has a triangular shaped cutting surface 114 disposed on the outer end thereof. The piston 110 reciprocates in the same direction as the housing 58 such that it both severs the core 44 and also provides a means for holding the core up into the guide shoe 48. Once the core is maintained in the guide shoe 48, the piston 74 is reciprocated upward and the housing 58 is also reciprocated upward. This results in the coring blades 26 being pulled upward and out of the sidewall of the bore hole 10 and the portion of the core in the guide shoe 48 being pulled upward also.

Figure 9:
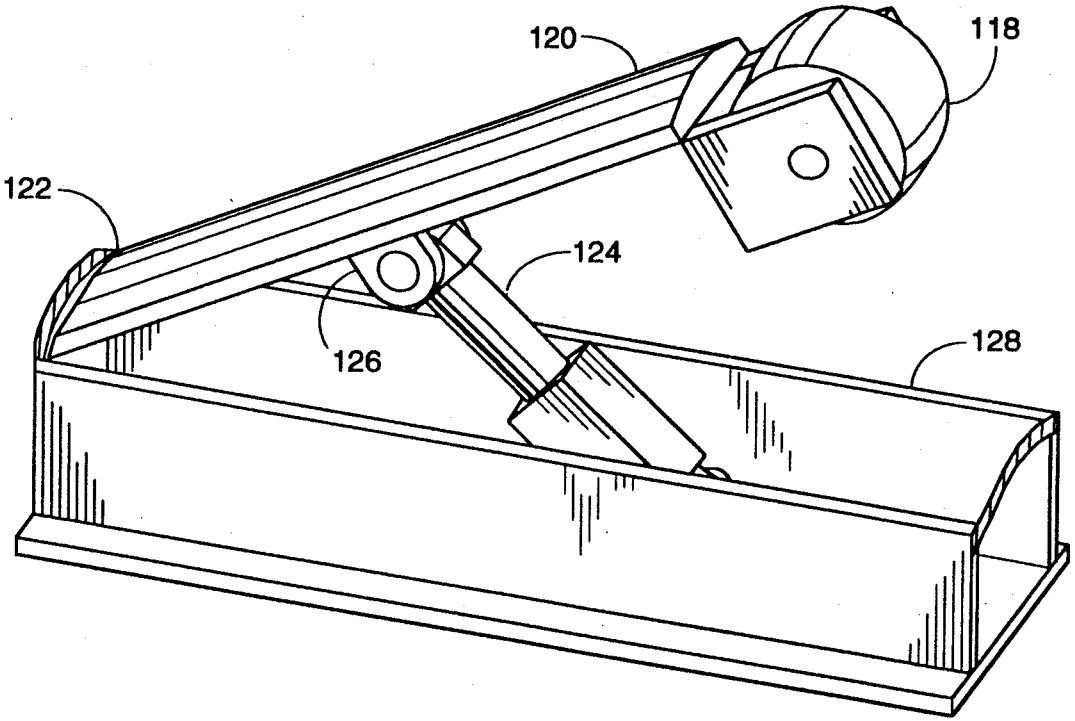
FIG. 9 illustrates a detail of the tilting mechanism for forcing the coring tube against the side of the bore hole.

Referring now to FIG. 9, there is illustrated a detail diagram of the stabilizing wheel 32. The stabilizing wheel 32 is comprised of a wheel 118 that is disposed on the end of a pivoting bracket 120. The pivoting bracket 120 is pivoted on one end thereof to a pivot point 122 with a piston 124 rotatingly anchored on one end thereof to a bracket 126 on the back side of the bracket 120 centrally disposed between the pivot point 122 and the wheel 118. The piston 124 has the other end thereof secured in a housing 128, the housing 128 is operable to receive the wheel 118 and the bracket 120 in a receded position.

Figure 10:
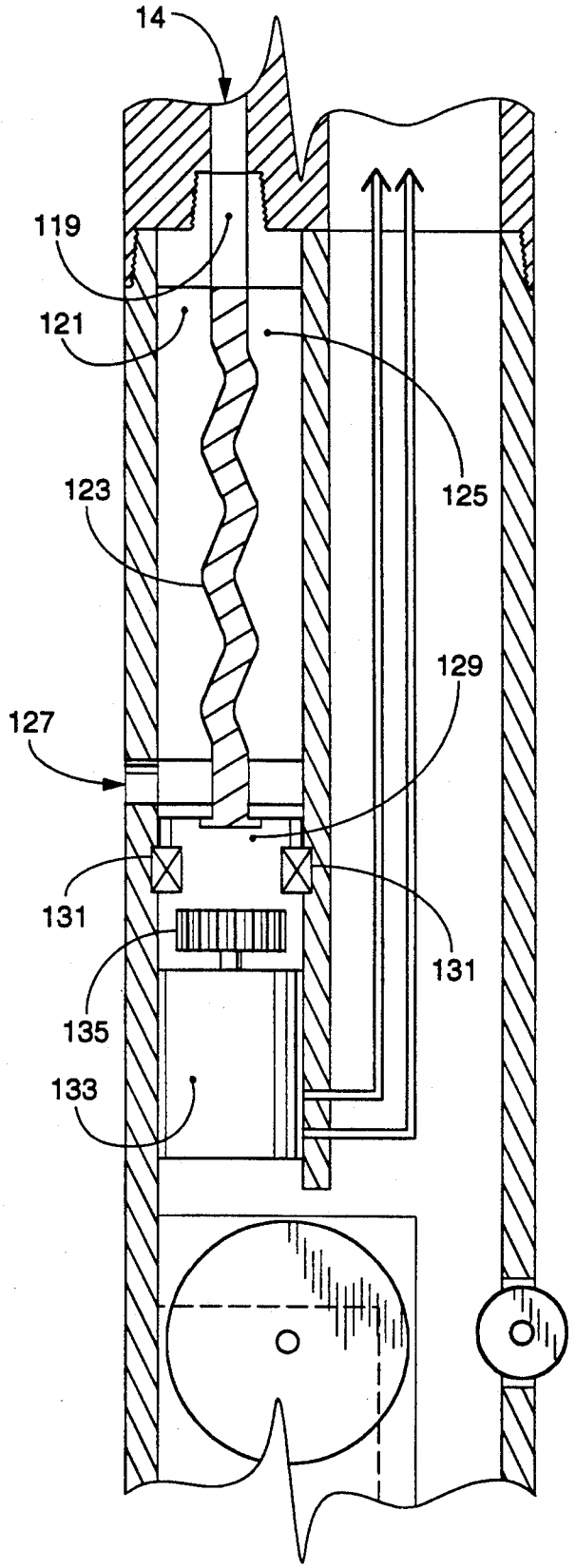
FIG. 10 illustrates the power source.

Referring now to FIG. 10, there is illustrated a detailed diagram of the power system which is operable to power the piston 74, 110 and 124. The mud stream enters at the upper end of an orifice 119 that is connected with the mud passageway 14 at the lower end of the assembly of FIG. 5 directly beneath the core guide 22 and core cutting mechanism 24. The mud stream enters the upper end of a positive displacement motor 121 (PDM) having a rotor 123 and a stator 125 associated therewith. The mud stream forcibly causes the rotor to turn within the fixed stator 125 by flowing between the rotor 123 and cavities of the stator 123, which stator 123 comprises a rubber element. This causes the rotor 123 to rotate at a high rpm and with significant power. This rotation is transmitted directly to a power converter drum 129 (PCD). The downward end of the rotor 123 is shaped to insert into a corresponding recess in the upper end of the PCD 129 to cause the PCD 129 to rotate as the rotor 123 turns. A cavity 127 is disposed between the bottom of the stator 125 and the top of the PCD 129 with an opening to the outside of the overall tool that allows the drilling mud to exit the tool and enter the wellbore. PCD 129 is suspended and supported within the structure of the tool by a sealed roller bearing assembly 131. The bearing assembly 131 allows the PCD 129 to rotate freely. The lower end of the PCD 129 is inset and shaped as a female gear component. A hydraulic pump 133 is fixed within the housing of FIG. 10. A male gear component 135 is installed upon its drive shaft. The male gear component 135 of the hydraulic motor 133 is meshed with female gear component of the PCD 129. As the PCD 129 is rotated, it causes the drive shaft of the hydraulic pump 133 to rotate. The hydraulic pump 123, in turn, circulates hydraulic fluid to operate the hydraulic cylinders and hydraulic motor components of the overall system.

Figure 11:
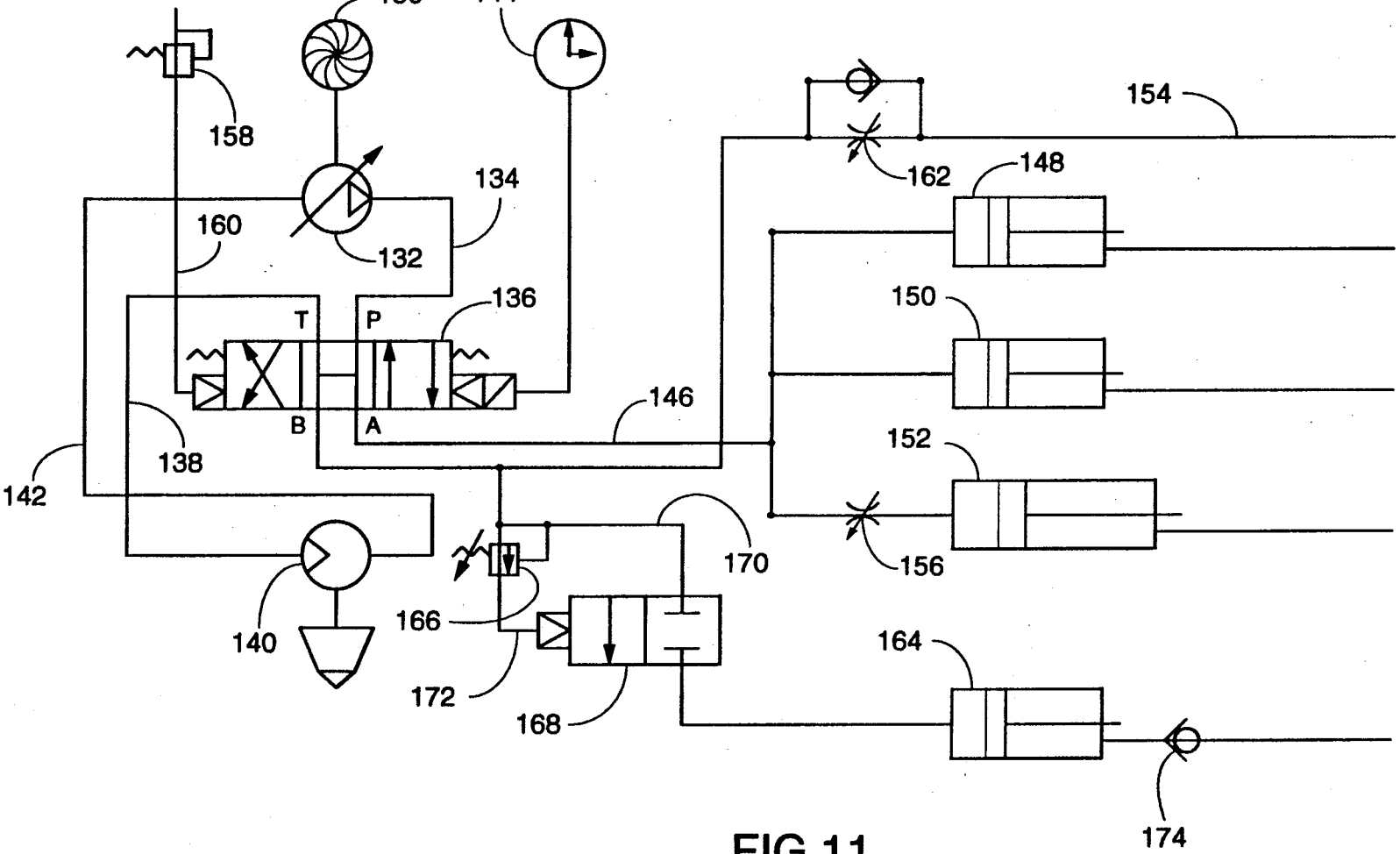
FIG. 11 illustrates a logic diagram of the hydraulic system.

Referring now to FIG. 11, there is illustrated logic diagram of the hydraulic system for controlling the coring mechanism. A turbine 130 is provided that rotates and generates fluid power through a variable displacement piston hydraulic pump 132. The hydraulic pump 132 circulates hydraulic fluid through a tube 134 into a hydraulic valve 136, through a hydraulic tube 138 and to a radial piston type hydraulic motor 140. The circuit is completed by fluid leaving the outlet port of the hydraulic motor 140 through a tube 142 and into the inlet port of the hydraulic pump 132. After the motor 140 has begun rotating, it delivers mechanical power to the gear box 24. Gears within the gear box split the power which rate of speed. The system is designed in the preferred embodiment to deliver approximately 5 horsepower to the coring blades 26 which will rotate at about 2000 rpm under load.

The coring sequence is initiated by setting a timer 144 at the surface which is disposed in the coring tool. The timer 144 will be set to a time in hours that will approximate the time necessary to trip into the well and position the coring mechanism. The timer 144 operates the hydraulic valve 136, which is a solenoid driven four-way hydraulic valve, pilot operated type with an open center spool. A 9 volt lithium battery is provided to power the timer 144 and the solenoid associated with the hydraulic valve 136. This entire assembly is enclosed in a pressure cell to prevent exposure to the drilling mud. The timer 144 and the associated battery will be high temperature components to permit operations up to approximately 150 degrees C.

Since the hydraulic valve 136 is spring centered, its non-actuated position is in the middle, or the open spool position. In this position, the hydraulic pump 132 simply circulates fluid into the port "P" of the valve 136, through port "T", through hydraulic tube 138 to the hydraulic motor 132. This causes the coring blades 26 to rotate as long as drilling mud is circulated through the turbine 130. Fluid flow continues from the hydraulic motor 140 through the hydraulic tube 142 to the intake port of the hydraulic pump 132, completing the closed loop circuit.

When the preset time in the timer 144 has expired, the solenoid-pilot actuation shifts the valve spool to the right position. This allows fluid to enter port "P", exit out port "A", through a connecting hydraulic tube 146 and into the blind ends of hydraulic cylinders 148, 150 and 152. The displaced fluid from the rod end of the hydraulic cylinders 148, 150 and 152 flows through a hydraulic tube 154 to port "B" of the hydraulic valve 136. It exists through port "T" and continues through the closed loop of the hydraulic motor 140 and hydraulic pump 132, through hydraulic tubes 138 and 142.

The hydraulic cylinders 148 and 150 correspond to the actuating mechanism for piston 124 and are utilized to extract the stabilizer wheels from inside the tool and exert force against the inside of the bore hole 10. This action positions the coring mechanism against the opposite side of the bore hole 10.

The hydraulic cylinder 152 corresponds to the hydraulic cylinder 34 and controls the motion of the coring blades 26 and the core guide assembly 22. A flow control valve 156 restricts flow to and from the hydraulic cylinder 152, slowing the action of the hydraulic cylinder 152. This permits a progressive loading of coring blades 26 and allows the coring blades 26 and core guide assembly 22 to move gradually into the coring position. This sequence also allows the coring blades 26 to be rotating at a high speed and under power before entering the formation. After the cylinders 148–152 have been fully extracted, the hydraulic valve 136 returns to its centered position and hydraulic fluid flow is continued only the hydraulic pump 132 and the motor 140. At this point the starting grooves have been cut into the formation and coring is ready to commence..

When the coring blades 26 are fully extended into the formation, the drill string is lowered into the well at a controlled rate of entry, and a triangular core is cut and extracted from the side of the well. When the desired length of core has been cut, the coring operation is concluded by dropping a steel ball into the drill string from the surface. The ball falls through the drill string until it enters a flow divider sub which is disposed at the upper portion of the connection 46. The ball seats into a recess which connects to one of two tubes which divert mud flow from inside the flow divider sub into the well bore. This forces the drilling mud to flow through two nozzles instead of three in this portion of the housing. This restriction to circulation of the drilling mud results in an instant increase in pressure inside the flow divider sub. This increase in pressure can be as high as 200–400 psi. An adjustable sequence valve 158 is provided for interconnection with the hydraulic valve 136 that will open as a result of the increase in pressure within this flow divider sub. The sequence valve can be adjusted to remain closed during normal circulating flows and pressures with allowances for normal surges or variations. It will open only upon the calculable and predictable increase in pressure due to closure of the flow tube by the steel ball.

The increase in pressure is transmitted to the pilot actuated side of the hydraulic valve 136 through a sense tube 160. This causes the valve spool in the hydraulic valve 136 to shift to the left position. The hydraulic fluid then enters the hydraulic valve 136 through port "P" and exits through port "B" into the hydraulic tube 154. The fluid is pumped into the rod ends of the hydraulic cylinders 148, 150 an 152 to cause them to retract. Fluid from the blind ends of the hydraulic cylinders 148, 150 and 152 is discharged into hydraulic tube 146, which conducts it to port "A" of valve 136 through port "T" and into the motor/pump circuit. This action returns the stabilizer wheels 32 and core cutting mechanism 24 into the housing. A flow control valve assembly 162 is provided in series with the hydraulic line 154 to slow the retracting of the hydraulic cylinders 148, 150 and 152 to allow the core catcher mechanism 108 to operate before closing.

The core catcher 108 includes a hydraulic cylinder 164, associated with piston 110, which causes the "guillotine" blade 114 to sever the core sample and retain it within the assembly for the trip out of the well. A flow control valve 166 is provided that senses the pressure in the hydraulic line 154. When the pressure is sensed, the control valve 25 actuates a pilot controlled hydraulic valve 168. The spool within the valve 168 shifts to the right and opens a circuit which allows fluid to flow through a hydraulic tube 170 into the blind end of the hydraulic cylinder 168 through hydraulic tube 172. This causes the cylinder 164 to extract, forcing fluid into the rod end of the cylinder 164 to be forced out into the well bore through a check valve 174.

After the hydraulic cylinders 148, 150 and 152 have been retracted and the hydraulic cylinder 164 has extracted, the valve 136 shifts to its center position. This concludes the coring operation. Mud circulation can then be stopped for the trip out, or resumed as needed for well control.

Figure 12:
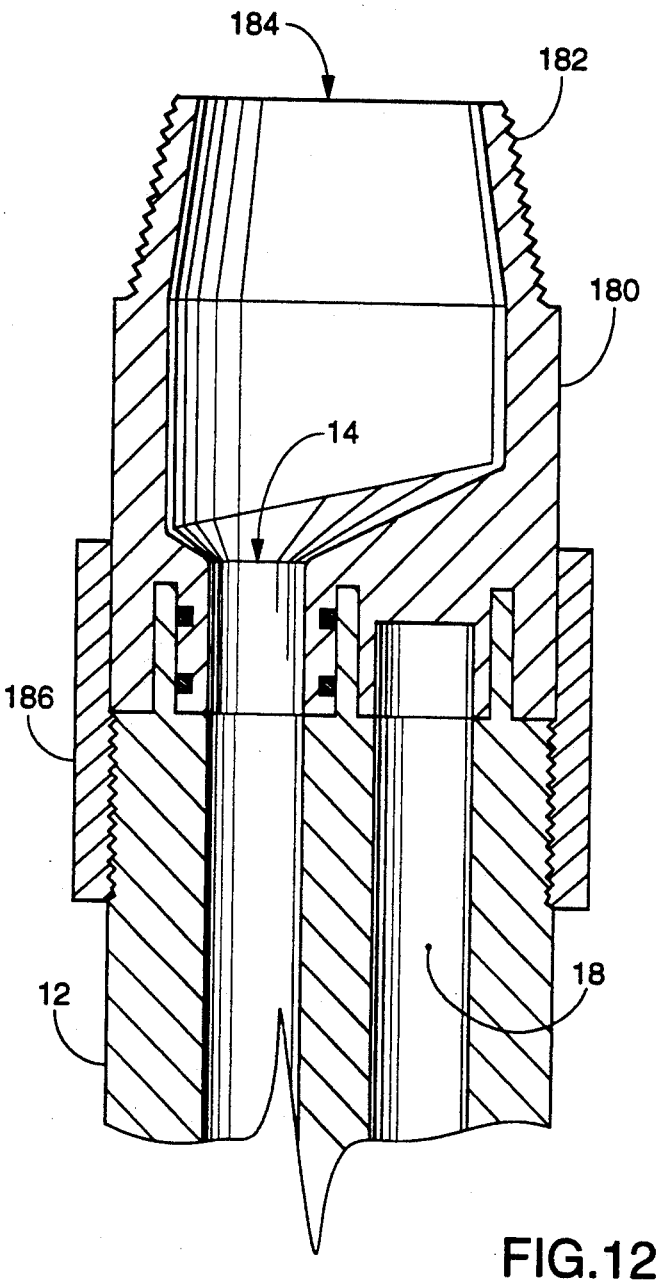
FIG. 12 illustrates the flow adapter sub.

Referring now to FIG. 12, there is illustrated a detail of a flow adapter sub 180 having threads 182 disposed on the upper end thereof interfacing with the drill string. The adapter sub 180 has a cavity 184 that is operable to interface with the mud stream flowing down the drill string and into the mud passageway 14. The mud passageway 14 is significantly narrower than the overall cavity 184, the overall flow adapter sub 182 operable to narrow this down and provide a transition from the drill string equipment to the coring assembling of the present invention. The adapter sub 180 also provides an upper cap or seal for the overall core storage tube 18 and also allows for an interface with the assembly 12 and is attached thereto with a collar 186.

Figure 13:
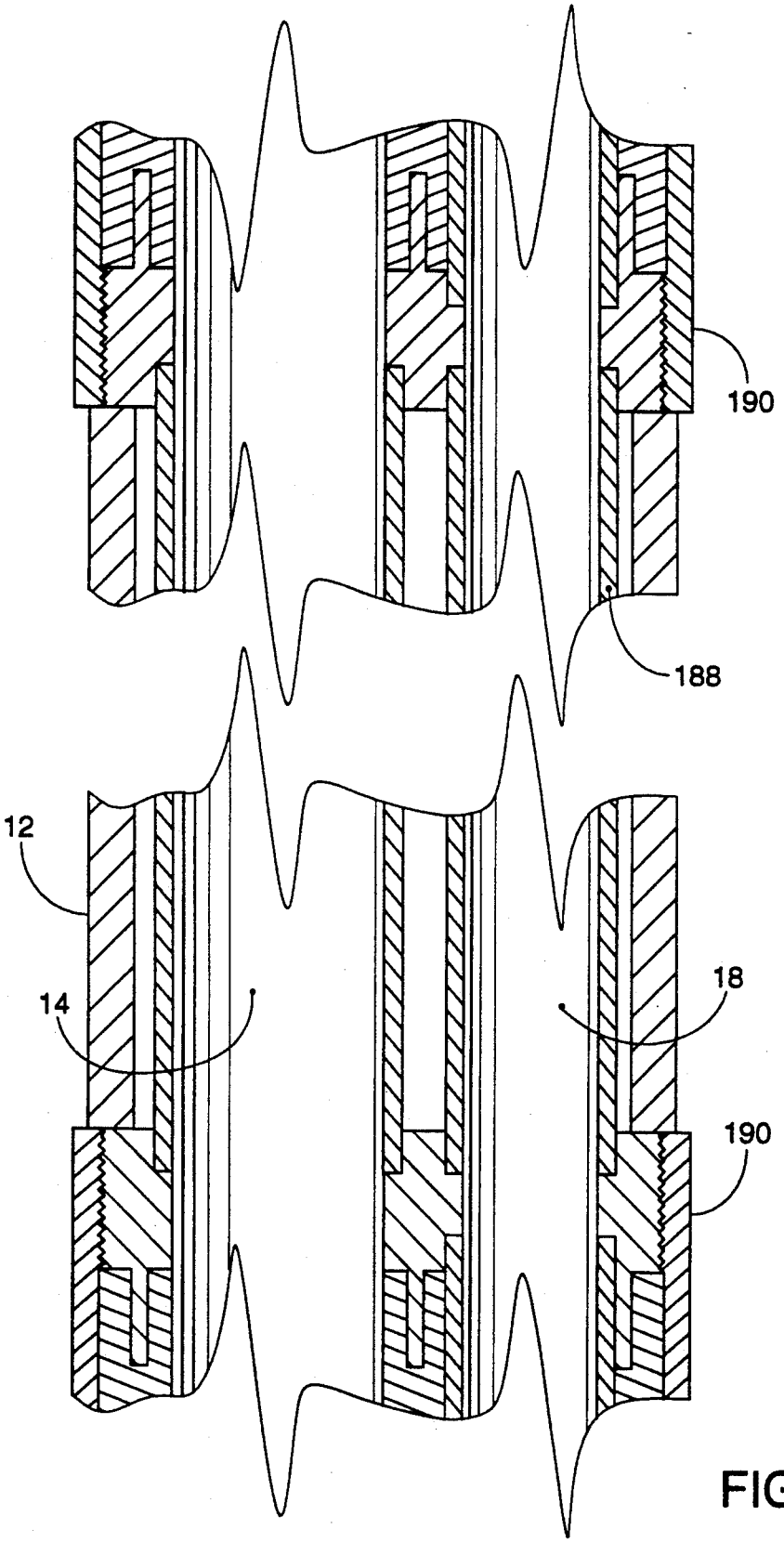
FIG. 13 illustrates a diagram of the flow and core storage assembly.

Referring now to FIG. 13, there is illustrated a detail of the flow and core storage assembly which is defined by the outer tube 12 having the core tube 18 and the mud flow passageway 14 disposed therein. This assembly provides an extension of the drilling mud flow tube through mud flow passageway 14. The core tube 18 is of such a size that an inner tube 188 constructed of fiberglass or PVC is fitted into the core storage tube 18. This inner tube 188 containing core samples can be removed from the assembly at the surface at the completion of a coring sequence, and after the assembly has been retrieved from the well. The sections of the inner tube 188 with core samples can be cut into convenient lengths, and sealed for transport from the well site to a core analysis laboratory. The assembly of FIG. 13 is approximately twenty-five to thirty feet in length. Multiple sections can be connected to provide storage for continuous core lengths of from thirty to two hundred feet, or more. Each section of the assembly of FIG. 13 on its lower end has an outer collar 190 with female threads with screws that screw onto the upper male threads on the outer housing of the next assembly.

Figure 14:
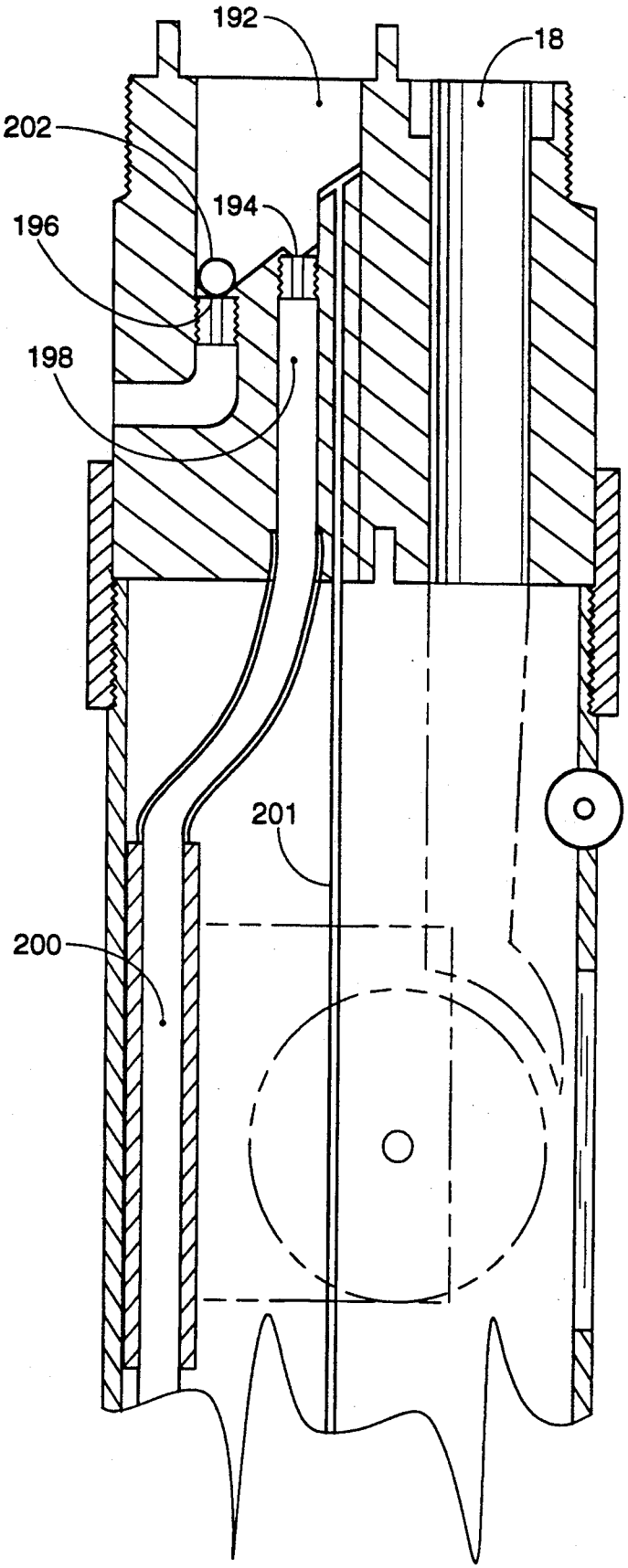
FIG. 14 illustrates a detail view of the flow control sub.

Referring now to FIG. 14, there is illustrated a detail of the flow control sub illustrating how the overall flow is controlled. At the upper end of the flow control sub, which flow control sub contains the cutting mechanism of FIG. 5, there is a cavity 192 provided with a first opening 194 and a second opening 196 associated therewith. The flow control sub is operable to determine which of these openings the mud flow is directed toward. The opening at 194 is operable to connect the cavity 192 to a mud passageway 198 which is then operable to connect to the next lower assembly containing the cutting mechanism to another mud passageway 200, which mud passageway 200 passes down to the PDM 121. The other opening 196 is connected to the exterior of the tool. Each of these openings 194 and 196 has disposed therein a nozzle of a predetermined size which is operable to restrict the flow through either or both of the openings 194 and 196. This allows control of the amount of drilling mud that is allowed to flow through the PDM 121.

During coring operation, both openings 194 and 196 are open. Drilling mud flow and operating pressure are monitored by the coring service technician on the drilling rig at the surface. A sealed Bourlon Pressure Tube inside the cavity responds to the operating pressure of the drilling mud within the cavity. The Bourlon Tube is illustrated by Reference 201 and extends from a point above the opening 194 downward in the assembly. The Bourlon Tube 201 is connected to the hydraulic flow control valve 136 illustrated in FIG. 11. The hydraulic flow control valve 136 is preset at the surface to actuate at a predetermined operating pressure. During coring operation, operating pressure on the drilling mud system is maintained at less than this pressure. When a coring sequence is completed, a steel ball 202 is dropped into the drill pipe at the surface. It falls through the drill string into the coring assembly and seats over the opening 196 as a result of the cavity 192 having a lower surface that is tilted such that the opening 194 is at a higher level along the face of this surface than the opening 196. Therefore, the steel ball 202 will drop on to the opening 196. This will form a valve seat, thus creating a higher operating pressure within the cavity 192 which the pressure is transmitted via the Bourlon Tube 201 to the hydraulic flow control valve. When the operating pressure exceeds the preset actuation level, the hydraulic flow control valve initiates the shutdown sequence which concludes the coring operation.

Although the preferred embodiment has been described in detail, it should be understood that various changes, substitutions and alterations can be made therein without departing from the spirit and scope of the invention as defined by the appended claims.

What is claimed is:

1. A sidewall coring tool for removing a selected section of the formation within a bore hole, comprising:

a housing for being lowered into the bore hole on the end of a drill string, said drill string operable to impart a vertically and downwardly directed force thereto along the longitudinal axis of the bore hole;

a longitudinal core tube formed interior to said housing and having an opening at one end for receiving core materials, said longitudinal core tube directed in an upward direction with the open end disposed on the lower end thereof;

a power source;

a coring device contained in said housing and operable to be disposed in a retracted non-cutting position in said housing and in an extended cutting position for core cutting and powered in the extended cutting position by said power source, said coring device when in the extended cutting position operable to be forced into the formation in the sidewall of the bore hole;

a motivating device for placing said coring device in said extended cutting position;

said coring device in the extended cutting position extracting a core from the sidewall of the bore hole in response to vertical movement of said housing; and a diverting device for diverting said core after formation thereof by said coring device upward into the open end of said core tube, the vertical downward movement of said housing forcing said core into said core tube.

2. The coring tool of claim 1 wherein said housing is rotationally fixed relative to said drill string.

3. The coring tool of claim 1 wherein said longitudinal core tube is disposed on one side of said housing, said one side being the side from which said coring device extends when in the extended cutting position.

4. The coring tool of claim 1 wherein said coring device extracts an essentially triangular-shaped cross-section of core from the sidewall of the bore hole.

5. The coring tool of claim 1 wherein said coring device includes at least two rotating blades that each rotate in a plane parallel to the longitudinal axis of the bore hole such that the planes of said blades intersect within the formation when said coring device is in the extended cutting position, the outermost edges of said coring blades being proximate to each other when in the extended cutting position.

6. The coring tool of claim 1 and further comprising a stabilizing device for forcing the surface of said housing from which said coring device extends in the extended cutting position against the sidewall of the bore hold in response to said motivating device placing said coring device in said extended cutting position.

7. A sidewall coring tool for removing a selected section of the formation within a bore hole, comprising:

a housing for being lowered into the bore hole on the end of a drill string, said drill string operable to impart a vertically directed force thereto along the longitudinally axis of the bore hole;

a longitudinal core tube formed interior to said housing and having an opening at one end for receiving core materials;

a coring device contained in said housing and operable to be disposed in a retracted non-cutting position in said housing and in an extended cutting position for core cutting, said coring device when in the extended cutting position operable to be forced into the formation in the sidewall of the bore hole;

a passageway for communicating with the drill string and for receiving mud flow from the drill string, mud flow passing through said passageway and out said lower end of said housing;

means for converting said mud flow into power for operating said coring device when in the extended position, said power generated in response to mud flowing through said passageway;

a motivating device for placing said coring device in said extended cutting position;

said coring device in the extended cutting position extracting a core from the sidewall of the bore hole in response to vertical movement of said housing; and a diverting device for diverting said core after formation thereof by said coring device into the open end of said core tube, the vertical movement of said housing forcing said core into said core tube.

8. A sidewall coring tool for removing a selected section of the formation within a bore hole, comprising:

a housing for being lowered into the bore hole on the end of a drill string, said drill string operable to impart a vertically directed force thereto along the longitudinal axis of the bore hole;

a longitudinal core tube formed interior to said housing and having an opening at one end for receiving core materials;

a power source;

a coring device contained in said housing and operable to be disposed in a retracted non-cutting position in said housing and in an extended cutting position for core cutting and powered in the extended cutting position by said power source, said coring device when in the extended cutting position operable to be forced into the formation in the sidewall of the bore hole;

a track for cooperating with said housing, said track providing a pathway between the retracted and extended positions of said coring device such that when said coring device moves from the retracted to the extended position, said coring device moves outward and downward relative to the longitudinal axis of said housing and, when moving from the extended position to the retracted position, said coring device moves upward and inward relative to the longitudinal axis of said housing;

means controlled by said power source for reciprocating said coring device along said track;

said coring device in the extended cutting position extracting a core from the sidewall of the bore hole in response to vertical movement of said housing; and a diverting device for diverting said core after formation thereof by said coring device into the open end of said core tube, the vertical movement of said housing forcing said core into said core tube.

9. A sidewall coring tool for removing a selected section of the formation within a bore hole, comprising:

a housing for being lowered into the bore hole on the end of a drill string, said drill string operable to impart a vertically directed force thereto along the longitudinal axis of the bore hole;

a longitudinal core tube formed interior to said housing and having an opening at one end for receiving core materials;

a power source;

a coring device contained in said housing and operable to be disposed in a retracted non-cutting position in said housing and in an extended cutting position for core cutting and powered in the extended cutting position by said power source, said coring device when in the extended cutting position operable to be forced into the formation in the sidewall of the bore hole;

a motivating device for placing said coring device in said extended cutting position;

said coring device in the extended cutting position extracting a core form the sidewall of the bore hole in response to vertical movement of said housing; and a diverting device for diverting said core after formation thereof by said coring device into the open end of said core tube, the vertical movement of said housing forcing said core into said core tube;

said longitudinal core tube disposed above said coring device such that the core formed thereby is forced upward into said coring tube by the coring operation.

10. A sidewall coring tool for removing a selected section of the formation within a bore hole, comprising:

a housing for being lowered into the bore hole on the end of a drill string, said drill string operable to impart a vertically directed force thereto along the longitudinal axis of the bore hole;

a longitudinal core tube formed interior to said housing and having an opening at one end for receiving core materials;

a power source;

a coring device contained in said housing and operable to be disposed in a retracted non-cutting position in said housing and in an extended cutting position for core cutting and powered in the extended cutting position by said power source, said coring device when in the extended cutting position operable to be forced into the formation in the sidewall of the bore hole;

a motivating device for placing said coring device in said extended cutting position;

said coring device in the extended cutting position extracting a core from the sidewall of the bore hole in response to vertical movement of said housing;

a diverting device for diverting said core after formation thereof by said coring device into the open end of said core tube, the vertical movement of said housing forcing said core into said core tube; and a core catcher operable at the end of the coring operation to sever the core prior to movement of said coring device from the extended position to the retracted position, said core catcher operable to retain the core formed in the coring operation within said core tube.

11. A method for sidewall coring of a formation within a bore hole, comprising the steps of:

providing a cutting tool that is disposed within a housing that forms a portion of a drill string along the longitudinal axis thereof;

lowering the drill string into the bore hole;

extending the cutting tool form a retracted position within the housing to and extended position such that the cutting tool is embedded in the sidewall of the formation;

lowering the drill string to allow a core to be formed by the cutting tool in response to the lowering of the drill string;

providing a core receptacle in the interior of the housing;

urging the formed core into the core receptacle; and retracting the cutting tool from the extended position to the retracted position at the end of the coring operation.

12. The method of claim 11 wherein the core receptacle is disposed above the position of the coring tool and the step of urging the formed core into the core receptacle comprises urging the formed core into the bottom end of the core receptacle and forcing it upward therein.

13. The method of claim 11 wherein the core receptacle comprises a core tube that is disposed above the cutting tool, the step of urging comprising:

providing a longitudinal core guide that communicates at one end with the lower end of the core tube with an open end at the other end thereof, the core guide operable to pivot at a point proximate to the opening in the lower end of the core tube such that the opposite end thereof is operable to rotate outward from the surface of the drill string, the lower end of the core guide disposed proximate to the cutting tool at the upper end thereof; and pivoting the lower end of the core guide outward in conjunction with extension of the cutting tool into the side wall of the formation such that the lower end of the core guide is disposed above the core when it is formed to receive the core and direct it upward into the core tube.

14. The method of claim 11 wherein the cutting tool is comprised of two rotating cutting blades with the planes thereof disposed at an angle with respect thereto such that a triangular shaped core will be formed.

15. The method of claim 14 wherein the step of extending the cutting tool into the sidewall formation comprises forcing the rotating saw blades outward and downward into the side wall formation prior to lowering the drill string.

16. The method of claim 11 and further comprising the step of forcing the side of the housing from which the cutting tool is extended against the surface of the formation within the bore hole.

17. The method of claim 11 and further comprising powering the cutting tool by passing mud through a passage way in the interior of the drill string and converting the mud flow into a power source, the power source operating the cutting tool.

* * * * *